US005906195A

United States Patent [19]

Georgaras

[11] Patent Number: 5,906,195

[45] Date of Patent: May 25, 1999

[54] VENTILATION SYSTEM

[75] Inventor: Stavros Georgaras, Brossard, Canada

[73] Assignee: Ko-Nik Equipment Inc., Saint-Hubert, Canada

[21] Appl. No.: 09/004,060

[22] Filed: Jan. 8, 1998

[30] Foreign Application Priority Data

Jan. 8, 1997 [CA] Canada ..... 2194703

[51] Int. Cl.[6] ..... F24C 15/20

[52] U.S. Cl. ..... 126/299 D; 126/299 R

[58] Field of Search ..... 126/299 R, 299 D; 55/DIG. 36

[56] References Cited

U.S. PATENT DOCUMENTS

| | | | |
|---|---|---|---|
| 3,400,649 | 9/1968 | Jensen | 126/299 D |
| 3,952,640 | 4/1976 | Kuechler | 55/DIG. 36 |
| 4,043,319 | 8/1977 | Jensen | 126/299 D |
| 4,047,519 | 9/1977 | Nett | 126/299 D |
| 4,089,327 | 5/1978 | Welsh | 55/DIG. 36 |
| 4,153,044 | 5/1979 | Nett | 126/299 D |
| 5,467,761 | 11/1995 | Kuechler | 126/299 D |

*Primary Examiner*—Carroll B. Dority
*Attorney, Agent, or Firm*—Robic

[57] ABSTRACT

A ventilation system having a hood located above cooking equipment which generates heat and fumes due to cooking. The hood has an inclined air filter at the back of the hood which rests on a flange extending along the length of the hood at the top thereof and the bottom of the inclined air filter rests on a grease collector extending along the length of the hood. The grease collector is located at a given distance downwardly from the top of the hood. The back of the inclined air filter defines an exhaust area, and the hood also includes an exhaust duct being in direct communication with the exhaust area and a fan for drawing the contaminated air out of the exhaust area. The hood also has a fresh air output that is connected to a fresh air duct including a fan and located along the length of the hood at the front thereof, this fresh air output being designed to inject fresh air into the hood. The invention is characterized in that the fresh air output of the hood is positioned to direct fresh air towards the inclined air filter at an upwards angle with respect to horizontal. The system further has a fresh air diffuser located behind the cooking equipment and near the floor, connected to the fresh air duct and being devised to diffuse air upwardly and downwardly. In use, the fresh air output forces the contaminated air to exit through the filter as it directs a steady stream of fresh air towards the filter. The fresh air diffuser feeds fresh air downwardly, which increases the burner efficiency of the cooking equipment and upwardly at the back of the cooking equipment, which creates air movement towards the hood, reducing the amount of stale air that is present near the floor and behind the cooking equipment.

7 Claims, 2 Drawing Sheets

VENTILATION SYSTEM

FIELD OF THE INVENTION

The present invention relates to a ventilation system, and more particularly to a ventilation system for use in a cooking area.

DESCRIPTION OF THE PRIOR ART

It is well known in the art to use hoods to ventilate cooking areas. Most of these hoods include an intake funnel, a fan connected to the intake funnel and an exhaust pipe. They also include a filter which must be changed or cleaned periodically. The hoods are usually located above the cooking areas in order to properly ventilate the same.

However, when such hoods are used in commercial cooking areas such as restaurants, some problems are associated with them. First of all, the heat generated by commercial cooking areas is much greater than by domestic areas. Therefore, the volume of air that must be evacuated is thus increased. Furthermore, since the fumes are sucked out of the area, there exists the possibility of stale air remaining at the bottom of the cooking equipment, which can create health problems and reduce the efficiency of the cooking equipment.

Such hoods also have a tendency to evacuate the commercial cooking area's ambient air, i.e. air conditioned air in the summertime and heated air in the wintertime, which results in uneven heat distribution on the floor or high heating bills, and which may even affect the heat distribution in the dining area.

In some cases, particularly commercial cooking areas, hoods are further provided with means to force fresh air towards the filter and thus increase the air flow, hereinafter referred to as the fresh air technique. This is done to help overcome the above-noted problem. The most common method of introducing fresh air is to either blow the air horizontally towards the filter or vertically downwardly.

A major problem associated with the horizontal forced fresh air technique is that unless it is properly balanced, it may create air inversion, which instead of evacuating the fumes and smoke, actually traps them inside the cooking area, particularly in the wintertime. Users have attempted to overcome this problem by altogether blocking the fresh air in the wintertime, which returns the user to the original problem of having ambient air evacuated.

If the air is blown vertically, it may create discomfort for the cooks using the cooking equipment.

There thus exists a need for a ventilation system which obviates the above-noted problems in the prior art.

SUMMARY OF THE INVENTION

It is thus an object of the invention to provide a ventilation system for use with cooking equipment located on a floor which increases the air flow, is more efficient, may reduce the amount of stale air located at the bottom of the cooking equipment, is easier to clean and minimizes the amount of ambient air that is evacuated.

In accordance with the invention, this object is achieved with a ventilation system comprising a hood located above the cooking equipment. The hood has a front, a back and a length and includes an inclined air filter at the back of the hood. The inclined air filter has a front, a back, a top and a bottom, where the top of the inclined air filter rests on a flange extending along the length of the hood at the top thereof and the bottom of the inclined air filter rests on a grease collector extending along the length of the hood. The grease collector is located at a given distance downwardly from the top of the hood. The back of the inclined air filter defines an exhaust area, and the hood also includes an exhaust duct being in direct communication with the exhaust area. The hood also includes exhaust means for drawing the contaminated air out of the exhaust area. The hood is further provided with a fresh air output that is operatively connected to a fresh air duct including fan means and located along the length of the hood at the front thereof, this fresh air output being designed to inject fresh air into the hood.

The invention is characterized in that the fresh air output of the hood is positioned to direct fresh air towards the inclined air filter at an upwards angle with respect to horizontal.

Preferably, the system further comprises at least one fresh air diffuser located behind the cooking equipment and generally adjacent the floor, the at least one fresh air diffuser being operatively connected to the fresh air duct and being designed to diffuse air upwardly and downwardly in predetermined proportions.

In use, the cooking apparatus will generate heat and fumes due to cooking, hereinafter referred to as contaminated air. These rise naturally towards the hood. The fresh air output further forces the contaminated air to exit through the filter as it directs a steady stream of fresh air towards the filter. Furthermore, the fresh air diffuser feeds fresh air downwardly, which increases the burner efficiency of the cooking equipment. The fresh air diffuser further feeds fresh air towards the hood at the back of the cooking equipment, which creates air movement towards the hood, thereby reducing the amount of stale air that may be present near the floor and behind the cooking equipment and increases the air flow towards the filter and out of the establishment.

One of the important advantages of the invention is that the fresh air that is inputted into the hood and at the bottom of the cooking equipment does not need to be heated or cooled. Furthermore, the fresh air is delivered in such a way that the burners of the cooking equipment burn more cleanly and efficiently.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

Figure 1:
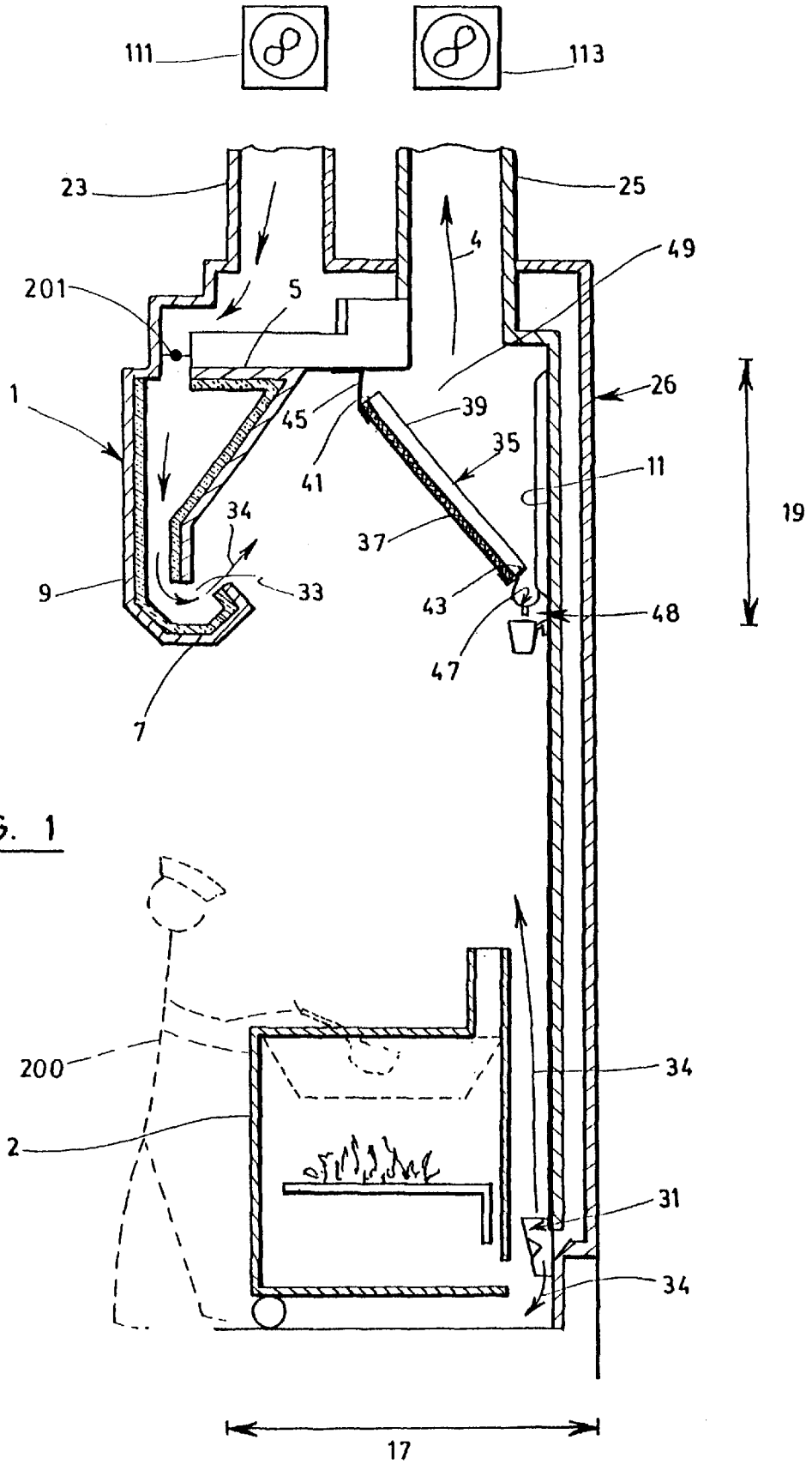
FIG. 1 is a cross-sectional side elevational view of a ventilation system according to a preferred embodiment of the invention.

The ventilation system according to the preferred embodiment of the invention shown in the accompanying drawings includes as its main component a hood 1. FIG. 1 shows is a cross-sectional side view of the hood 1 according to the invention. As seen in FIG. 1, the hood is located above cooking equipment 2 which rests on a floor. The cooking equipment 2 can be a grill, a fryer, an oven, etc. When the cooking equipment 2 is in use, it produces a mixture of heat, grease and fumes, referred to as contaminated air 4.

The hood 1 has a top 5, a bottom 7, a front 9, a back 11, two opposite sides 13, a length 15, a width 17, a height 19, a fresh air intake duct 23 and an exhaust duct 25, both located at the top 5 of the hood 1. The height 19 is preferably a minimum of 30 inches.

Figure 3:
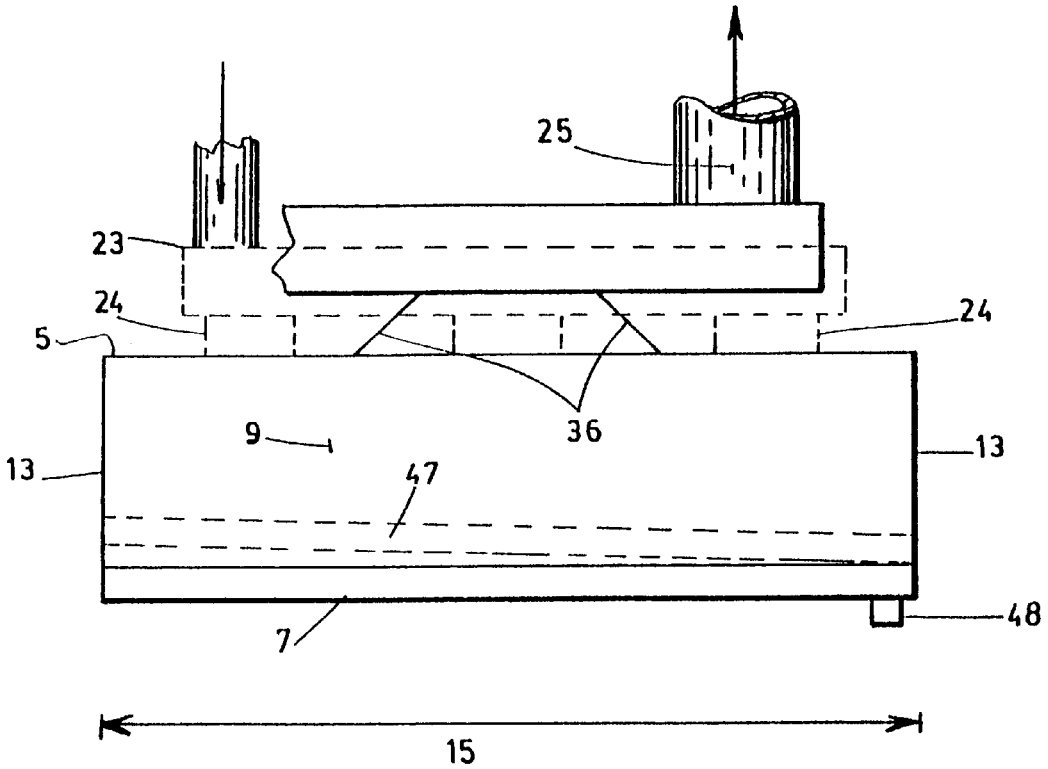
FIG. 3 is front schematic representation of the hood of FIG. 1.

The hood 1 has a fresh air output 33, along its length at the front 9 thereof and an inclined filter 35 at the back thereof 11. The inclined filter 35 has a front 37, a back 39, a top 41 and a bottom 43. The top 41 of the inclined filter 35 rests on a flange 45, extending along the length 15 of the hood 1, the flange 45 being located at the top 5 of the hood 1 approximately halfway between the front 9 and the back 11. The bottom 43 of the inclined filter 35 rests on a grease collector 47, also extending along the length 15 of the hood 1, the grease collector 47 being located at a given distance downwardly from the top 5 of the hood 1. Preferably, as can be seen on FIG. 1, the grease collector 47 has the cross-sectional shape of a generally rounded gutter so as to better collect the grease dripping from the filter 35 and to make it easier to clean. Preferably, the grease collector 47 is inclined with respect to the horizontal so as to channel the grease towards a proper collector 48, or stopper, at one or the other side of the hood 1. Thus, the grease collector has two opposite ends, one of which is provided with a collector or stopper, and which is also lower than the other opposite end (see FIG. 3, in dotted lines).

The back 39 of the filter 35 defines an exhaust area 49 which is in direct communication with the exhaust duct 25.

The fresh air output 33 is in direct communication with the fresh air intake duct 23 and directs fresh air 34 towards the filter 35. Preferably, the fresh air output 33 is angled upwardly in order to not create an air inversion, which would trap the contaminated air over the cooking apparatus 2. It has been found that the most efficient angle is 45°. Also preferably, the fresh air output 33 is provided with a longitudinal opening of approximately one inch.

Figure 2:
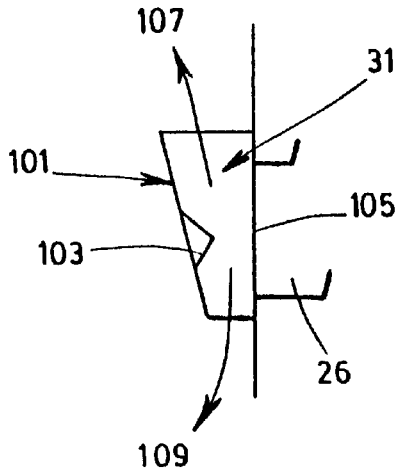
FIG. 2 is a detailed cross-sectional side view of the fresh air diffuser.

As better shown on FIG. 2, at least one fresh air diffuser 31, is located near the floor. The fresh air diffuser 31 is in direct communication with the fresh air intake duct 23 and includes a diffuser 101 for diffusing fresh air 34 vertically towards the top 5 of the hood 1 and vertically downwardly in predetermined proportions. The diffuser includes an air splitter 103 which splits air between the two vertical directions. The diffuser 101 has an input 105 connected to the fresh air duct 23 and two outputs 107, 109. The diffuser and the air splitter are preferably made of aluminium. The diffuser 101 is fastened to the wall. The proportion of air that is directed in each vertical direction can be adjusted by adjusting the vertical location of the air splitter 103.

The fresh air intake duct 23 includes a ventilator 111 for injecting fresh air 34 into the system and feeding it to the fresh air output 33 and to the fresh air diffuser 31. As better shown on FIG. 3, the fresh air intake duct 23 (in dotted lines) feeds fresh air 34 into the fresh air output 33 through three secondary ducts 24 which can be appropriately placed according to the user's needs. It should be noted that the number of secondary ducts 24 are a function of the length of the hood 15 and are adequately placed in order to provide optimal air flow.

The fresh air intake duct 23 also feeds fresh air 34 through at least one other secondary duct 26 to the fresh air diffuser 31. The secondary ducts 24, 26 are properly insulated so as to permit the gradual heating of the fresh air 34 during the winter in order to avoid condensation and to prevent inconvenience to the users. It should be noted that, depending on the length of the hood 1, the ventilation system may include more than one fresh air diffuser 31, which are appropriately placed in order to provide optimal burn for the cooking equipment.

The exhaust duct 25 includes a ventilator 113 for forcing contaminated air out of the hood 1 and to the outside of the cooking area. The exhaust duct includes a domed exit 36 located in the middle of the hood 1 as better shown on FIG. 3. The dimensions of the domed exit 36 are calculated according to standard air volume displacement requirements. The domed exit 36 has a shape which lessens the strain on the ventilator as it naturally pulls the contaminated air 4 upwardly towards the ventilator.

In use, when a user 200 uses the cooking apparatus 2, contaminated air 4 is produced which must be evacuated. The contaminated air 4 rises naturally towards the top of the hood 1 and towards the filter 35. The fresh air output 33 further forces the contaminated air 4 to exit through the filter 35 as it directs a steady stream of fresh air 34 towards the filter 35. Furthermore, the fresh air diffuser 31 feeds fresh air vertically through the output 109, which increases the burner efficiency of the cooking apparatus 2. The fresh air diffuser 31 further feeds fresh air 34 vertically through output 107, which creates air movement towards the top 5 of the hood 1, thereby reducing the amount of stale air that may be present near the floor and increasing the air flow towards the filter and out of the establishment. The ventilation system as described has the additional advantage of drawing minimal air from the rest of the establishment, as it pulls sufficient air fed from the fresh air output 33 and the fresh air diffuser 31.

The ventilation system as described above is efficient, worker friendly, environmentally friendly and inexpensive to install and operate.

One of the important aspects of the invention is that the fresh air that is inputted into the hood and at the bottom of the cooking equipment does not need to be heated or cooled and is delivered in such a way to the burners of the cooking equipment that the burners burn more cleanly and efficiently.

It should be noted that the sizes of ductwork and openings of entry or exit of required air volumes are readily calculable for an expert in the field, and thus no detail is provided herein. Also, in order to meet standard requirements for safety, the secondary ducts 24 may be provided with fire dampers 201.

Although the present invention has been explained hereinabove by way of a preferred embodiment thereof, it should be pointed out that any modifications to this preferred embodiment is not deemed to alter or change the nature and scope of the present invention, as defined in the appended claims.

What is claimed is:

1. A ventilation system for use with cooking equipment resting on a floor, said system comprising:

a hood located above said cooking equipment, said hood having a front, a back and a length and including an inclined air filter at said back, said inclined air filter having a front, a back, a top and a bottom, where said top of said inclined air filter rests on a flange extending along said length of said hood at the top thereof and said bottom of said inclined air filter rests on a grease collector extending along said length of said hood, said grease collector being located at a given distance downwardly from said top of said hood, the back of said inclined air filter defining an exhaust area, said hood also including an exhaust duct that is in direct communication with said exhaust area and includes exhaust means, said hood further having a fresh air output operatively connected to a fresh air duct including fan means, said fresh air output being located along said length of said hood at the front thereof and being designed to inject fresh air into the hood, said fresh air output of said hood being positioned to direct fresh air towards said inclined air filter at an upwards angle with respect to horizontal, characterized in that:

said system further comprises at least one adjustable fresh air diffuser, said at least one adjustable fresh air diffuser being located behind said cooking equipment and generally adjacent said floor, said at least one fresh air diffuser being operatively connected to said fresh air duct and being devised to diffuse air upwardly and downwardly in predetermined proportions.

2. A system according to claim 1, wherein said fresh air output has a longitudinal opening having a width substantially equal to one inch, said opening extending along said length of said hood.

3. A system according to claim 2, wherein said upwards angle is equal to about 45°.

4. A system according to claim 1, wherein said grease collector has two opposite ends and a cross-sectional shape in the form of a generally rounded gutter, and wherein said grease collector is provided with a plug adjacent one of said opposite ends, said one opposite end being located at a height lower than the other one of said opposite ends.

5. A system according to claim 2, wherein said grease collector has two opposite ends and a cross-sectional shape in the form of a generally rounded gutter, and wherein said grease collector is provided with a plug adjacent one of said opposite ends, said one opposite end being located at a height lower than the other one of said opposite ends.

6. A system according to claim 3, wherein said grease collector has two opposite ends and a cross-sectional shape in the form of a generally rounded gutter, and wherein said grease collector is provided with a plug adjacent one of said opposite ends, said one opposite end being located at a height lower than the other one of said opposite ends.

7. A ventilation system for use with cooking equipment resting on a floor, said system comprising:

a hood located above said cooking equipment, said hood having a front, a back and a length and including an inclined air filter at said back, said inclined air filter having a front, a back, a top and a bottom, where said top of said inclined air filter rests on a flange extending along said length of said hood at the top thereof and said bottom of said inclined air filter rests on a grease collector extending along said length of said hood, said grease collector being located at a given distance downwardly from said top of said hood, the back of said inclined air filter defining an exhaust area, said hood also including an exhaust duct that is in direct communication with said exhaust area and includes exhaust means, said hood further having a fresh air output operatively connected to a fresh air duct including fan means, said fresh air output being located along said length of said hood at the front thereof and being designed to inject fresh air into the hood, said fresh air output of said hood being positioned to direct fresh air towards said inclined air filter at an upwards angle with respect to horizontal, characterized in that:

said system further comprises at least one fresh air diffuser, said at least one fresh air diffuser being located behind said cooking equipment and generally adjacent said floor, said at least one fresh air diffuser being operatively connected to said fresh air duct and being devised to diffuse air upwardly and downwardly in predetermined proportions.

* * * * *